United States Patent [19]

Ross

[11] 4,336,815

[45] Jun. 29, 1982

[54] GROOMING APPARATUS

[76] Inventor: Abraham Ross, 23 E. 26th St., New York, N.Y. 10010

[21] Appl. No.: 194,006

[22] Filed: Oct. 6, 1980

[51] Int. Cl.[3] ..... A45D 24/08

[52] U.S. Cl. ..... 132/143; 132/76.2

[58] Field of Search ..... 132/76.2, 79, 83 E, 132/143

[56] References Cited

U.S. PATENT DOCUMENTS

| | | | |
|---|---|---|---|
| 1,405,532 | 2/1922 | Marko | 132/83 E |
| 1,530,070 | 3/1925 | Bovee | 132/79 |
| 1,591,515 | 7/1926 | Diskin | 132/79 R |
| 2,168,804 | 8/1939 | Payson | 132/76.2 |
| 2,224,995 | 12/1940 | Vogel | 132/83 E |
| 2,503,163 | 4/1950 | Maddox | 132/83 E |

*Primary Examiner*—G. E. McNeill

*Attorney, Agent, or Firm*—Robert D. Farkas

[57] ABSTRACT

A comb and nail file unit utilizes a comb-like device having a plurality of teeth extending outwardly, in parallel relationship, from a spine portion of the comb-like device. A blade-like nail treatment device, similar to a nail file or knife, is removably and hingeably secured to the spine portion of the comb-like device and is recessable in an elongated slot located in such spine portion. The blade, when extended outwardly from the spine portion, may be locked in such extended portion, by engaging a slot formed by closing together two parts of a housing. The housing removably secures the comb in a cavity formed by the two parts, when closed. The housing also secures a pair of mirrors, one of which is hingeably secured to the other and extensible outwardly of the housing when the housing is either in a closed or open condition.

9 Claims, 7 Drawing Figures

GROOMING APPARATUS

BACKGROUND OF THE INVENTION

1. The Field of the Invention

This invention relates to comb devices and housings therefor, to which are fitted knives or files, in combination. Such class includes devices wherein the blade element may be disposed outwardly, when in a locked position, from either the comb position or the housing.

2. Description of the Prior Art

The prior art abounds with comb devices, usually in the form of pocket combs, having blade fixtures attached thereto.

U.S. Pat. No. 2,260,093 issued on Oct. 21, 1941 to O. J. Rainville is typical of the classes of devices in which a blade-like device is attached to the comb-like device utilizing a hinge mechanism therefor. The blade of Rainville, when extended outwardly from a notch-like slot, extending along the length of the spine of the comb portion, may be maintained in such outward position, resisting pivotable motion of the blade portion, utilizing a camming action of the blade portion therefor. However, such camming action, located adjacent the pivot point of the Rainville blade, permits rotation in one direction, being the direction in which the blade may be re-stored within the slot or groove located within the body of the comb apparatus and, prevents further rotation, from a preset angular relationship, in which the blade and the longitudinal axis of the spine portion of the comb portion are aligned. The blade in Rainville, is described as being a nail file.

U.S. Pat. No. 2,630,212 issued Mar. 3, 1953 to A. Mosch teaches a general utility compact having a plurality of blade-like elements pivotably secured to a portion of the compact device. Each of the blade-like attachments are provided having a notch, such notch being located in the periphery of the blade-like element, located adjacent the pivot point. A spring-like element is secured to the compact such that the free end of the spring-like element is provided with a curved portion, complimentary in shape to the notch portions aforementioned. Thus, when the blade-like elements are singularly pivoted so as to extend outwardly from a stored position, within portions of the compact case, the spring-element maintains such blade elements at preferred angular relationships and outwardly from the compact housing, thereby allowing the blade elements to be utilized. However, in similar fashion to Rainville, there is no positive locking mechanism which prevents rotation of the blade-like element in one direction, as in Rainville, or in both directions, as in Mosch. Thus, the blade elements of Mosch may be pivoted to angular positions, other than the preferred position, on rotating on applying sufficient force to the blade-like element to overcome the detenting actions of the spring element.

U.S. Pat. No. 2,122,226 issued June 28, 1938 to W. A. Wyman describes a comb-like apparatus having stored therewithin totally removable elements, such as nail files and the like, such that the nail file element may be removed from a cavity loaded in the spine of the comb portion of the apparatus upon supplying sufficient force to the nail file to overcome the forces exerted on the nail file by fixed springs, mounted to the nail file. In a use position, the nail file, or tweezers, may be removed totally from the comb cavity, and separated therefrom. Such device fails to provide an apparatus in which the comb and the blade-like elements, the nail file or tweezers, may be attached to each other at all times and fails to provide an apparatus in which such blade-like elements can be positioned at a preferred working position and locked thereinto whilst utilizing the blade-like elements that are extended outwardly from the comb-like apparatus.

SUMMARY OF THE INVENTION

A primary object of the present invention is to provide a comb-like apparatus, having a blade-like element pivotably and removably secured thereto, such that the blade-like element may be stored substantially entirely within the comb-like element when not in the use position and pivotably stored outwardly therefrom when in such use position, without restraining forces acting thereon.

Another object of the present invention is to provide a housing for enclosing the comb-like apparatus, for storage purposes, whilst permitting the blade-like element to be disposed outwardly from the housing into a use position and locked in said use position.

Still another object of the present invention is to provide the housing with a mirror-like device, a portion of which may be pivotably secured outwardly of the housing, when said housing is in an open or closed position.

Yet another object of the present invention is to provide said housing with functional elements, such as a nail file, a blade, a mirror, each of which may be independently positioned outwardly of the housing, when the housing is either in an open or a closed position, so as to preclude from view a comb, otherwise removably secured to said housing and stored therewithin when not in use.

A further object of the present invention is to provide an inexpensive housing which in combination with a variety of grooming elements contained therewithin, retains said grooming elements within said housing in a near totally enclosed condition, precluding dirt and contamination from entering or emerging the interior of said housing.

Heretofore, tool elements, such as nail files, knife blades, razors, combs, tools, knives, forks, spoons, and other mechanical implements have been pivotably secured to housing-like structures, such that one or more of such elements may be moved outwardly from a storage position to a use position. However, each of the prior art apparatuses fail to provide a method in which some implements, such as combs, may be fully detached from the housing, whilst when such comb-like devices are stored within the housing, maintaining the comb-like devices clean and otherwise unaffected by dirt and contamination. Further, prior art devices fail to teach methods in which the aforementioned tools or implements were positioned outwardly of the housing in a preferred location and locked thereinto in a positive fashion. Resisted forces, of sufficient magnitude, permitted prior art implements to be moved from a use position back into their storage positions, or away from a preferred use location.

The present invention overcomes these objects by providing a housing, which housing substantially consists of two parts hinged together. Such parts, when closed, form a cavity thereinbetween. A space is provided within such cavity for the storage of substantially, a conventional comb. Such comb, however, is provided having an elongated slot extending the length of its spine. A pin, secured to the comb spine, and transverse to the slot, resides adjacent one end thereof. A nail file, or if desired a blade element, is pivotably secured to such pin, utilizing a tortuous path slot disposed at one end thereof. Thus, the file element may be removably secured to the comb, if desired, stored within the elongated slot, or, pivoted outwardly from the spine of the comb into a use position. The housing, has one of the portions thereof adapted with a notch whose size is substantially equivalent to the cross section of the nail file or blade. Thus, when the comb is stored within the housing, the nail file is pivoted outwardly from the comb, a portion of the nail file extends in the slot in the wall of the housing and is secured in such slot by the closing of the other half of the housing. The nail file cannot move from its preferred angular relationship, as it extends outwardly from the closed housing except by opening the housing. Similarly, a mirror element, having two parts, has one part thereof secured to one portion of the housing, the other portion being pivotably secured to the secured mirrored portion. Another slot, disposed in the walls of a housing element permits the movable mirror element to be placed in a position extending outwardly of the housing when it is closed or, folded back on the secured stationary mirrored element such that both mirrored elements are contained within the cavity of the housing formed by closing both housing halves. Additional cavity space, provided within the housing, may be utilized for the site of indicia or other materials, such as pills and the like.

These objects as well as other objects of the present invention will become more readily apparent after reading the following description of the accompanying drawings.

DESCRIPTION OF THE PREFERRED EMBODIMENT

Figures 1, 2, 3, 4, 5, 6, 7:
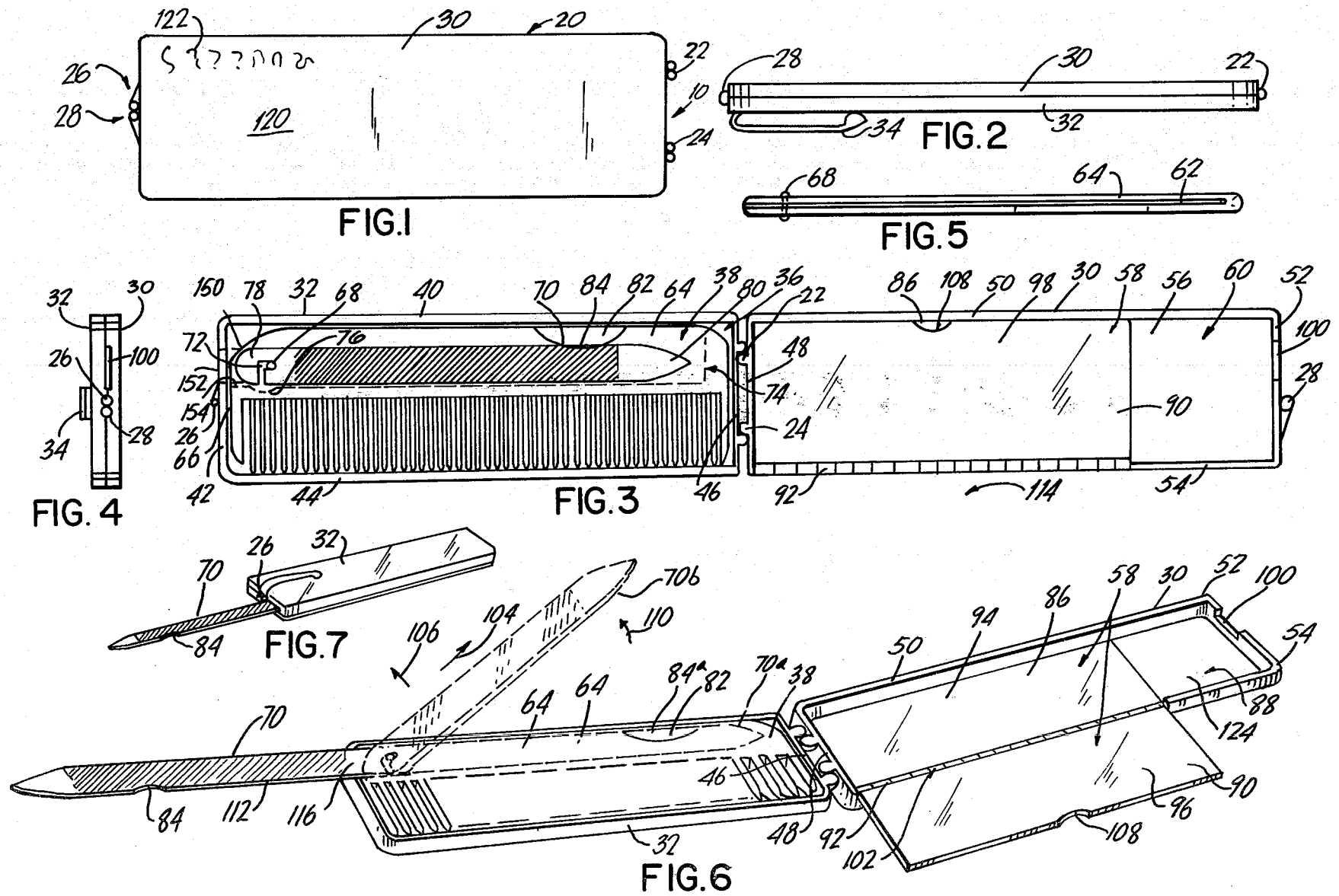
FIG. 1 is a front elevation view of the housing, shown in a closed position.
FIG. 2 is a top elevation view of the apparatus shown in FIG. 1.
FIG. 3 is a front elevation view of the housing shown in FIG. 1, in an open position.
FIG. 4 is a side elevation view of the apparatus shown in FIG. 1, in a closed condition.
FIG. 5 is a top view of the comb element, shown in FIG. 3.
FIG. 6 is a perspective view of the apparatus shown in FIG. 3, illustrating a portions of the apparatus shown extended outwardly from the housing.
FIG. 7 is another perspective view of the apparatus shown in FIG. 1, illustrating an apparatus extended outwardly from the housing.

Now referring to the figures, and more particularly to the embodiment illustrated in FIG. 1 showing the present invention 10 utilizing a housing 20. The housing includes hinge elements 22 and 24, and clasp elements 26 and 28, each being well known in the art. Hinge elements 22 constitute protrusions, one of which is affixed to housing element 30, the other of which is affixed to housing element 32. In similar fashion, hinge elements 24 are affixed to housing element 30 and 32 and pivotably secured to each other. Clasp element 28 is shown attached to housing element 30 and clasp element 26 is shown attached to housing element 32. When engaged, clasp elements 26 and 28 retain housing elements 30 and 32 in a closed condition. When clasp element 26 and 28 are manipulated so as be disengaged, housing element 30 and 32 may be pivoted so as to open, as shown FIGS. 3 and 6.

Spring clip 34, well known in the art, is secured on exterior surface 36 of housing element 32.

When housing elements 30 and 32 are open, as shown more particularly in FIG. 3, cavity 36, shown in housing element 32, is exposed. Comb element 38 may be stored within cavity 36 and may be removed therefrom, if desired. Walls 40, 42, 44 and 46 define cavity 36 in housing element 32. Walls 48, 50, 52 and 54 define cavity 56 in housing element 30. Shown stored within a portion of cavity 56 is mirror element 58. Portion 60, of cavity 56, is shown as a void. Comb 38 is shown provided having elongated slot 62 extending in spine portion 64 thereof. Slot 62 extends substantially along the entire length of spine portion 64 and is shown emerging from edge 66 of comb 38.

Pin or rivet 68 is shown traversing elongated slot 62 adjacent edge 66 of comb 38. Nail file 70 as shown in FIG. 3, has L-shaped slot 72 thereof engaged with pin 68, and is shown residing within dotted lines 74, depicting the outline of elongated slot 62. Excursion 76, in dotted lines 74, permit end 78 of nail file 70 to freely pivot about pin 68, when end 80 of nail file 70 is moved upwardly and towards pin 68. As can be seen, from notch 82 is provided in spine portion 64 of comb 38. Depression 84 permits a user's fingernail to pass through thumb notch 80 and engage nail file 70 so as to permit such nail file to be pivoted upwardly and towards pin 68, if desired. As can be seen, comb 38 may be removed from cavity 36 or retained therein, as shown.

Mirror element 58 utilizes stationary portion 86 secured to surface 88 defining the floor of cavity 56. Any convenient means of attachment may be employed. Mirror element 90 is shown pivotably secured to mirror element 86, utilizing conventional butt-like hinge element 92 therefor. Surfaces 94, 96, and 98 of mirror element 86 and 90 respectively are highly polished and thus, highly reflective. Thumb notch 108, shown in mirror element 90, permits mirror element 90 to be pivoted upwardly and away from mirror element 86 when housing element 30 is opened relative to housing element 32.

Walls 50 and 54 are separated by a region defining notch 100. Notch 100 is adapted to have a depth substantially equivalent to the thickness of nail file 70. Walls 54 and 48 are separated by notch 102. Notch 102 is of a depth equivalent to the thickness of mirror element 90, such that when mirror element 90 is folded over onto mirror element 86, as shown in FIG. 3, surface 98 resides in a plane defined by the upper marginal edges of walls 50, 54 and 48. The length of notch 102 corresponds substantially with the length of butt hinge 92. Dotted lines 70A indicate the position of nail file 70, when shown stored within spine portion 64 of comb 38. Dotted lines 70B illustrates an intermediate position for comb 70, as nail file 70 is pivoted outwardly from its storage position within elongated slot 62. If desired, a force directed along the direction of arrow 104, followed by a force exerted on nail file 70B, in the direction of arrow 106, permits the nail file, shown by dotted lines 70B, to be totally disengaged from comb 38. Continued rotation, in the direction of arrow 110, permits nail file 70 to have its longitudinal axis extend substantially parallel to the length of elongated slot 62 and have portion 112 thereof reside outwardly from housing element 32. When housing element 30 is moved in the direction of arrow 114, notch 100 resides covering portion 116 of nail file 70, locking the nail file against rotation in either the direction of arrow 114, or in an opposite direction. The action of pin 68 prohibits file 70 from disengagement from spine portion 64.

Mirror element 90 may be maintained outwardly from the closed housing, formed by closing together housing elements 30 and 32.

If desired, mirror element 90 may be retained entirely within housing 20 by folding mirror element 90 in juxtaposed relationship with mirror element 58. Both mirror element 90 and nail file 70 may be disposed outwardly of housing 20, either one at a time or both at one time. Nail file 70 may be totally removed from engagement from comb element 38 or may remain pivotably secured thereto, in either a stored position or emerging outwardly from housing 20, when closed. Additionally, comb element 38 may be totally removed from housing 20 when carrying nail file 70 or when nail file 70 is disengaged from home element 38. Knife-like elements, or other utility devices may be substituted for nail file 70. Similarly, other flat-like elements, such as the cards, nail treatment abrasive boards, similar in shape to mirror element 90, may be substituted for mirror element 90. Void 60 may be utilized for the storage of other materials, such as pills, clips, stamps or the like. Surface 120 may carry indicia 122.

As can be seen in FIG. 4, the only opening in housing 20, when closed, is notch 100. Slot 102 is filled by mirror element 90, when mirror element 90 is in its folded up condition, as shown in FIG. 3. Thus, the ability for comb 38, cavity portion 60 and mirrored surfaces 94, 96 and 98 to become contaminated is minimized. If desired, end 78, of nail file 70, may be extended as shown by dotted lines 150, 152, and 154, so as to have slot 100 totally filled, even when file 70 is in the position shown in FIG. 3. If such be the case, then, comb 70, mirror elements 58, cannot be contaminated at all, since walls 40, 42, 44 and 46 all are of uniform height and since notch 100 would be occupied by a portion of nail file 70, residing adjacent end 78 thereof, and since butt hinge 92 would totally fill notch 102, thereby totally sealing cavities 36 and 56 from exposure to the atmosphere.

One of the advantages of the present invention is a comb-like apparatus, having a blade-like element pivotably and removably secured thereto, such that the blade-like element may be stored substantially entirely within the comb-like element when not in the use position and pivotably stored outwardly therefrom when in such use position, without restraining forces acting thereon.

Another advantage of the present invention is a housing for enclosing the comb-like apparatus, for storage purposes, whilst permitting the blade-like element to be disposed outwardly from the housing into a use position and locked in said use position.

Still another advantage of the present invention is the housing with a mirror-like device, a portion of which may be pivotably secured outwardly of the housing, when said housing is in an open or closed position.

Yet another advantage of the present invention is a housing with functional elements, such as a nail file, a blade, a mirror, each of which may be independently positioned outwardly of the housing, when the housing is either in an open or a closed position, so as to preclude from view a comb, otherwise removably secured to said housing and stored therewithin when not in use.

A further advantage of the present invention is an inexpensive housing which in combination with a variety of grooming elements contained therewithin, retains said grooming elements within said housing in a near totally enclosed condition, precluding dirt and contamination from entering or emerging the interior of said housing.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follow:

1. A combined comb and nail treatment device comprising a housing, said housing including a first housing element and a second housing element, said first housing element pivotably secured to said second housing element, said first housing element including a base and side walls and an open mouth portion, said second housing element including a base and side walls and another open mouth portion, said base and said side walls of said first housing element defining a first cavity in said first housing element, said base and said side walls of said second housing element defining a second cavity within said second housing element, a comb, said comb having a spine portion and a plurality of elongated teeth, a first elongated notch dispersed in said spine portion of said comb, a blade-like element, said blade-like element pivotably secured to said spine portion of said comb, said comb removably engaged within said first cavity, means to entirely confine said comb within said first cavity and said second cavity when said open mouth portion of said first housing element is disposed in juxtaposed relationship over said another open mouth portion of said second housing element, means to extend a portion of said blade-like element outwardly from said first notch of said comb, means to secure said portion of said blade-like element against rotation when said portion of said blade-like element is extended outwardly of said first and said second housing element are juxtaposed over one another, wherein said means to secure said portion of said comb against rotation includes a second notch, said second notch being disposed in one of said side walls of the said second housing.

2. The apparatus as claimed in claim 1 wherein said second notch is configured to have a depth equal to the thickness of said blade-like element and a width substantially equal to the width of said blade-like element.

3. The apparatus as claimed in claim 1 wherein said blade-like element comprises a nail file.

4. The apparatus as claimed in claim 1 wherein said means to extend said portion of said blade comprises a pin, a notch being disposed at one end of said blade-like element, said notch removably and pivotably engaging said pin.

5. The apparatus as claimed in claim 4 wherein said notch has an L-like shape.

6. The apparatus as claimed in claim 1 further comprising a first flat-like mirror-like element, a second flat-like mirror-like element, said first mirror-like element being secured to the interior of said second cavity, said second mirror-like element being pivotably secured to said first mirror-like element, means to entirely house said first mirror-like element and said second mirror-like element when said second mirror-like element is juxtaposed over said first mirror-like element entirely within said portion of said second cavity, means to extend substantially entirely the said second mirror-like element outwardly of said second cavity when said second housing element is juxtaposed over said first housing element into a closed condition.

7. The apparatus as claimed in claim 6 wherein said means to extend said second mirror-like element comprises a third notch, said third notch being disposed in said side walls of said second housing.

8. The apparatus as claimed in claim 7 wherein said third notch is configured to have a dimension substantially equal in thickness to the thickness of said second mirror-like element and a length substantially equal to the lenght of said second mirror-like element.

9. The apparatus as claimed in claim 1 further comprising means to releasably clamp together said first and said second housing element when said first housing element is disposed justaposed over said second housing element.

* * * * *